United States Patent [19]

Appel et al.

[11] Patent Number: 4,824,593

[45] Date of Patent: Apr. 25, 1989

[54] ANTIFOAM INGREDIENT

[75] Inventors: Peter W. Appel, Rotterdam, Netherlands; Fabrizio Bortolotti, Wirral, Italy; Francois Delwel, Dordrecht, Netherlands; Fredrik Hornung, Gouderak, Netherlands; Alan D. Tomlinson, Vlaaringen, Netherlands; Simon Willemse, Vlaardingen, Netherlands

[73] Assignee: Lever Brothers Company, New York, N.Y.

[21] Appl. No.: 84,004

[22] Filed: Aug. 10, 1987

[30] Foreign Application Priority Data

Aug. 13, 1986 [GB] United Kingdom ..... 8619683

[51] Int. Cl.[4] ..... C11D 9/60; C11D 9/24; C11D 9/36

[52] U.S. Cl. ..... 252/127; 252/90; 252/126; 252/174.13; 252/321; 252/358; 264/4.4

[58] Field of Search ..... 252/90, 126, 127, 174.13, 252/321, 358; 264/4.4

[56] References Cited

U.S. PATENT DOCUMENTS

| | | | |
|---|---|---|---|
| 2,954,347 | 9/1960 | St. John et al. | 252/358 |
| 3,399,144 | 8/1968 | Hathaway et al. | 252/321 |
| 4,637,890 | 1/1987 | Crabtree et al. | 252/174.13 |

FOREIGN PATENT DOCUMENTS

| | | |
|---|---|---|
| 47611 | 8/1982 | European Pat. Off. . |
| 210721 | 2/1987 | European Pat. Off. . |
| 940127 | 10/1963 | United Kingdom . |
| 1424406 | 2/1976 | United Kingdom . |
| 1425177 | 2/1977 | United Kingdom . |
| 1507312 | 4/1978 | United Kingdom . |
| 1509797 | 5/1978 | United Kingdom . |
| 1551239 | 8/1979 | United Kingdom . |
| 1554482 | 10/1979 | United Kingdom . |

*Primary Examiner*—Robert A. Wax
*Attorney, Agent, or Firm*—Milton L. Honig

[57] ABSTRACT

An antifoam ingredient suitable for incorporation into a detergent powder comprises an antifoam material, for example, a hydrocarbon and/or a polysiloxane together with hydrophobic silica, enclosed within a matrix formed of a mixture of fatty acid and fatty acid soap.

16 Claims, No Drawings

ANTIFOAM INGREDIENT

TECHNICAL FIELD

The present invention relates to an antifoam ingredient which is particularly suitable for incorporation into powdered detergent products, and to processes for the production of the antifoam ingredient.

BACKGROUND AND PRIOR ART

Detergent products comprising anionic and/or nonionic surfactants which are particularly suitable for fabric washing generally have a tendency in use to produce excessive foam. This can be a problem particularly with drum-type washing machines, and it is accordingly usual to include an antifoam agent in the detergent formulation to reduce or eliminate this tendency to produce excessive foam.

Excessive foam derived from detergent products containing anionic and/or nonionic surfactants can for example be controlled to a limited extent by the addition of soap, or by the incorporation of certain oils, such as hydrocarbons or silicone oils, or particles such as hydrophobic silica, or mixtures of such materials.

It has, for example, been proposed in GB No. 1 571 501 (Unilever) to provide a detergent powder composition comprising a lather controller consisting of a polyvalent salt of an alkyl phosphoric acid, such as calcium stearyl phosphate, and a hydrocarbon. The lather controller can be sprayed onto the detergent powder prior to packaging.

Although such antifoams are highly effective in reducing the tendency of a freshly manufactured detergent product to produce excessive foam, there is still a substantial risk that the antifoam activity will diminish on storage in a detergent powder. This is believed to be due to migration of some of the antifoam active substances, particularly those of an oily nature, into the surrounding powder or even the packaging material. This can happen more rapidly when such powders are stored at temperatures above room temperature (20° C.), and after a period of storage of a few weeks the activity of the antifoam agent can be severely impaired.

It is accordingly desirable to incorporate the antifoam agents in the detergent powder during manufacture in a form in which they are protected against premature deactivation during storage, so that their effectiveness in controlling excessive foam production, both at low and at high washing temperatures, is not diminished.

We have now discovered that deactivation of the antifoam ingredient during storage in a powder detergent product can be substantially reduced or eliminated altogether, and sensitivity to foam control at both low and high wash temperatures maintained, if the antifoam ingredient is a particulate material comprising antifoam material supported in an oil-impervious matrix formed by a mixture of free fatty acid and soap. Premature loss during storage of any oily antifoam material by migration from within the particles into the dry detergent powder product or even into the packaging, is thereby restricted or eliminated. By this means, antifoam material is retained within the particle until contacted with water, for example during the washing of fabrics, when its release can then be triggered to produce effective foam control. The effectiveness of the antifoam ingredient is thereby retained until it is needed at the point of use.

GB No. 1 507 312 (Unilever) relates to coated particulate material in which the coating comprises an alkali metal salt of a long chain fatty acid having 8 to 22 carbon atoms and a free fatty acid having 8 to 22 carbon atoms in a weight ratio within the range of 1:4 to 2:1. Amongst the several particulate materials which are listed as being suitable for coating are foam inhibitors, but the specification does not identify any particulate substances that can be employed in foam control. There is no suggestion that the coating material is suitable for encapsulating oily antifoam materials, thus preventing premature loss which would lead to deactivation during storage, while at the same time ensuring that the oily materials are readily available when required for foam control.

EP No. 210 721A (Dow Corning), published on 4 Feb. 1987, discloses antifoam granules comprising silicone oil carried on a water-insoluble matrix of fatty acid and/or fatty alcohol melting at 45°-80° C.: in the wash liquor the silicone oil is released by melting of the matrix material.

DEFINITION OF THE INVENTION

The present invention provides a particulate solid antifoam ingredient suitable for incorporation into a detergent powder, the antifoam ingredient being in the form of a matrix comprising a mixture of a $C_{8-22}$ fatty acid and an alkali metal soap of a $C_{8-22}$ fatty acid, said mixture having a liquid phase content at 40° C. of not more than 50% by weight, enclosing an antifoam material comprising an antifoam active substance and optionally a antifoam promoter.

The mixture of fatty acid and fatty acid soap used as the matrix material in the antifoam ingredient of the invention will be referred to hereinafter as the acid soap.

DISCLOSURE OF THE INVENTION

The Acid Soap

The particulate antifoam ingredient of the invention comprises a matrix to form a protective coating around the antifoam material to ensure, suring storage of the antifoam ingredient prior to use, that premature leakage or loss, in particular of oily antifoam active substances, from the antifoam ingredient is prevented. Solid antifoam active substance and solid or liquid antifoam promoters also enjoy extra protection from the matrix during storage. By this means, the ability of the antifoam ingredient to control or reduce the development of foam when employed in a domestic or industrial process is maintained without significant deactivation.

For this purpose, the matrix comprises a mixture of fatty acid and fatty acid soap, which when formed as a matrix around the antifoam material, provides an oil-impervious coating. The fatty acid and fatty acid salt selected to provide the matrix of acid soap should have a liquid phase content at 40° C. of not more than 50% by weight.

It is preferred that the liquid phase content of the acid soap at 40° C. should be not more than 30%, more preferably not more than 20%, most preferably not more than 10% and ideally not more than 1%.

The requirement for the acid soap at 40° C. to have a liquid phase content of not more than 50%, with preferences for decreasing values, is an appropriate means for expressing the need for the structure of the acid soap matrix to remain rigid at normal storage temperatures, including storage under semi-tropical conditions, which could reach 40° C., so as to lessen the chance of leakage of antifoam material leading to deactivation.

The liquid phase measurement at 40° C. is conveniently made using pulse NMR.

The acid soap may if desired contain soaps and/or fatty acids of more than one chain length, and the chain lengths of the fatty acid(s) and soap(s) may be the same or different. Preferred fatty acids and soaps are those having from 12 to 18 carbon atoms in the molecule, examples of which are lauric acid, myristic acid, palmitic acid, stearic acid, oleic acid and the corresponding soaps. One preferred matrix is formed from a mixture comprising lauric acid together with sodium stearate and/or sodium palmitate.

The weight ratio of free fatty acid to soap is preferably within the range of from 0.25:1 to 2:1, a range of from 0.67:1 to 1.5:1 (2:3 to 3:2) being especially preferred.

It is also preferred that the Krafft point of the fully neutralised soap or soap mixture corresponding to the acid soap be within the range of from 10° to 60° C., more preferably from 20° to 60° C. The Krafft point of a soap is defined as that temperature above which the soap becomes readily soluble in water. It was initially believed by the present inventors that a "Krafft point" could be determined for an acid soap, but subsequent work showed that since the presence of the free fatty acid always produced turbid solutions, the results obtained were not rigorous. The relevance of the Krafft point to the present invention is in connection with the dissolution and release properties of the acid soap matrix in the wash liquor, and the Krafft point of the corresponding fully neutralised soap appears to provide a reasonable measure of this. It was also thought by the present inventors in the early stages of the present work that the "Krafft point" of the acid soap needed to be within the range of from 10° to 40° C., and was preferably within the range of from 20° to 40° C., but again subsequent work has indicated that the Krafft point of the corresponding fully neutralised soap may be as high as 60° C., and indeed the preferred range is from 20° to 60° C.

THE ANTIFOAM MATERIAL

The antifoam ingredient of the invention contains antifoam material which is capable of controlling the production of foam to a desirable level when employed in conjunction with a detergent product, for example, in the washing of fabrics in an automatic washing machine. The antifoam material preferably comprises an antifoam active substance usually together with an antifoam promoter.

The antifoam active substance is a hydrophobic material that is at least partially liquid at a temperature of from 5° to 90° C., a range corresponding to the range of wash temperatures normally encountered. Thus the antifoam active substance is oily or waxy in nature. Advantageously, the antifoam active substance is selected from hydrocarbons, polysiloxanes, and mixtures thereof.

The antifoam active substance is desirably used in conjunction with an antifoam promoter, which is a particulate material capable of promoting the antifoam function of the antifoam active substance.

Advantageously, the antifoam active material comprises:

(a) a hydrophobic antifoam active substance at least partially liquid at a temperature of from 5° to 90° C., which is selected from hydrocarbons, polysiloxanes and mixtures thereof;

and, optionally, (b) an antifoam promoter selected from (b)(i) alkyl phosphoric acids or salts thereof, the acids having the structure:

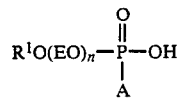

(1)

Where A is —OH or $R^2O(EO)_m$—, $R^1$ and $R^2$ are the same or different $C_{12}$ to $C_{24}$, straight or branched chain, saturated or unsaturated alkyl groups, m and n are the same or different and are O, or an integer of from 1 to 6;

(b)(ii) hydrophobic silica; and (b)(iii) mixtures thereof.

(a) The hydrophobic antifoam active substance

(a)(i) The Hydrocarbon

Hydrocarbons which can be employed as antifoam actives are those which are liquid at 20° C. and those which usually liquefy at a temperature of from 20° to 90° C., more preferably from 30° to 70° C. These former hydrocarbons can accordingly be those which are normally liquid at room temperature, and the latter are those which are normally solid or semi-solid at room temperature and which are sometimes referred to as waxes, or they can comprise a mixture of normally liquid and normally solid or semi-solid hydrocarbons.

These hydrocarbons are either natural in origin, in which case they can be derived from mineral, vegetable or animal sources, or they can be synthetic in nature.

The preferred hydrocarbons are of mineral origin, especially those derived from petroleum, including paraffin oil, microcrystalline and oxidised microcrystalline waxes, petroleum jelly ("VASELINE") and paraffin waxes. Petroleum jelly is a semi-solid hydrocarbon wax, usually having a liquefaction point of from about 35° to 50° C., and comprising a mixture of normally liquid hydrocarbons and normally solid hydrocarbons. Synthetic waxes, such as Fischer-Tropsch and oxidised Fischer-Tropsch waxes, or Montan waxes, or natural waxes, such as beeswax, candelilla and carnauba waxes can be used if desired. Any of the waxes described can be used alone or in admixtures with other hydrocarbon waxes.

The antifoam active substances can also comprise other normally liquid hydrocarbons of mineral origin, as well as normally liquid hydrocarbons which are vegetable or animal oils. Examples of the latter are vegetable oils such as sesame oil, cotton seed oil, corn oil, sweet almond oil, olive oil, wheat germ oil, rice bran oil, or peanut oil, or animal oils such as lanolin, neat's foot oil, bone oil, sperm oil or cod liver oil. Any such oils used preferably should not be highly coloured, of strong odour or otherwise inacceptable for use in a detergent composition.

Further examples of normally liquid hydrocarbon materials, that is hydrocarbons which are normally liquid at temperatures below 40° C., include hydrocarbons usually having a melting point of from −40° C. to 5° C. and usually containing from 12 to 40 carbon atoms in the molecule. The normally liquid hydrocarbon will usually have a minimum boiling point of not less than 110° C. Liquid paraffins, preferably of the naphthenic or paraffinic type, also known as mineral white oil are preferred. Particularly suitable are those chosen from mineral oils such as spindle oil (Velocite 6: Mobil), paraffin oil and other liquid oils such as those in the WTO-5 series as available from British Petroleum.

(a)(ii) The polysiloxane

Siloxanes which can be employed as antifoam actives are polysiloxanes having the structure:

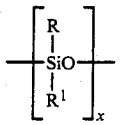

where R and R′ are the same or different alkyl or aryl groups having from 1 to 6 carbon atoms; and x is an integer of at least 20.

The preferred polysiloxanes are polydimethylsiloxanes, where both R and R′ are methyl groups.

The polysiloxanes usually have a molecular weight of from 500 to 200,000 and a kinematic viscosity of from 50 to $2\times10^6 mm^2sec^{-1}$. Preferably, the polysiloxanes have a kinematic viscosity of from $5\times10^2$ to $5\times10^4 mm^2sec^{-1}$, most preferably from $3\times10^3$ to $3\times10^4 mm^2sec^{-1}$ at 25° C. The polysiloxane is generally end blocked with trimethylsilyl or hydroxyl groups, but other end-blocking groups are also suitable.

Examples of suitable commercially available polysiloxanes are the polydimethyl siloxanes, "Silicone 200 Fluids", available from Dow Corning, having viscosities of from 50 to $5\times10^4 mm^2sec^{-1}$.

For convenience, the term "silicone oil" will be used hereinafter to denote liquid polysiloxane.

(b) The antifoam promoter

The antifoam promoter will generally be a substance which is water insoluble and is deployed as finely divided solid particles when the antifoam ingredient is contacted with a large volume of water, for example in the control of foaming during the washing of fabrics. The antifoam promoter can also be a substance which is converted to finely divided solid water insoluble particles when contacted with calcium or magnesium ions normally present in hard water.

The antifoam promoter is preferably chosen from certain alkyl phosphoric acids or slts thereof, hydrophobic silica, and mixtures of these materials.

(b)(i) The alkyl phosphoric acid or salt thereof

Alkyl phosphoric acids or salts thereof, which can be employed as antifoam promoters can be derived from acids having the structure:

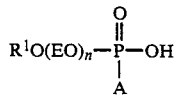

(1)

where A is —OH or $R^2O(EO)_m$—, $R^1$ and $R^2$ are the same or different, $C_{12}$–$C_{24}$, preferably $C_{16}$–$C_{22}$, straight or branched chain, saturated or unsaturated alkyl groups, especially $C_{16}$–$C_{18}$ linear saturated groups, and m and n are the same or different and are O or an integer of from 1 to 6. Preferably A is —OH and n is O, so that the compound is a monoalkyl phosphoric acid, preferably with a linear alkyl group. If any ethylene oxide (EO) groups are present in the alkyl phosphoric acid, they should not be too long in relation to the alkyl chain length to make their respective calcium or magnesium salts soluble in water during use.

In practice, the alkyl phosphoric acid or salt is usually a mixture of both mono- and di-alkylphosphoric acid residues, with a range of alkyl chain lengths. Predominantly monoalkyl phosphates are usually made by phosphorylation of alcohols or ethoxylated alcohols, when n or m is an integer of from 1 to 6, using a polyphosphoric acid. Phosphorylation may alternatively be accomplished using phosphorus pentoxide, in which case the mixed mono- and di-alkyl phosphates ar produced. Under optimum reaction conditions, only small quantities of unreacted materials or by-products are produced, and the reaction products advantageously can be used directly in the antifoam ingredient.

The substituted phosphoric acids of structure (1) above may be used as stated in acid or salt form, that is either as the partial salt, or preferably as the full salt. When an antifoam ingredient comprising an alkyl phosphoric acid is added to a detergent composition, it will normally be neutralised by the more basic ingredients of the composition, to form usually the sodium salt, when the detergent composition is dispersed in water. When using the composition in hard water, the insoluble calcium and/or magnesium salt can then be formed, but in soft water some of the alkyl phosphate can remain as the alkali metal, usually sodium, salt. In this case, the addition of calcium and/or magnesium ions, in the form of a water-soluble salt thereof is necessary to form the particulate, insoluble corresponding salts of the alkyl phosphate. If the alkyl phosphate is employed as the alkali metal or ammonium salt form, then again the calcium and/or magnesium salt is formed on use in hard water.

it is also possible to use a preformed insoluble alkyl phosphoric acid salt, with a polyvalent cation which is preferably calcium, although aluminium, barium, zinc, magnesium or strontium salts may alternatively be used. Mixtures of the insoluble alkyl phosphoric acid salts with the free acid or other soluble salts, such as alkali metal salts, can also be used if desired. The preferred insoluble alkyl phosphoric acid salts need not be totally water-insoluble, but they should be sufficiently insoluble that undissolved solid salt is present in the wash liquor, when the antifoam ingredient forms part of a detergent product employed in the laundering of fabrics.

The preferred alkyl phosphate used in accordance with the invention is stearyl phosphate.

(b)(ii) The Hydrophobic Silica

The antifoam promoter can also comprise a hydrophobic particulate silica. Any type of silica can be employed in the preparation of hydrophobic silica. Preferred examples are precipitated silica and pyrogenic silica which can be converted to a hydrophobic form by treatment, for example with chloro-alkylsilanes, especially dimethyldichlorosilane, or by treatment, for example with an alcohol, especially octanol. Other suitable agents can be employed in the preparation of hydrophobic silica.

The hydrophobic silica should preferably have a surface area of $>50m^2g^{-1}$ and a particle size of $<10$ μm, preferably $<3$ μm.

Examples of commercially available hydrophobic silicas include Sipernat (Trade Mark) D10 and D17 available from Degussa, Wacker (Trade Mark) HDK P100/M, available from Wacker-Chemie and Cabosil (Trade Mark) N70 TS available from Cabot Corp.

Also available commercially are mixtures of silicone oil and hydrophobic silica, for example, DB 100 available from Dow Corning, VP 1132 available from Wacker-Chemie, and Silcolapse (Trade Mark) 430 available from ICI. These materials may be prepared by a method in which the silica is rendered hydrophobic in situ: hydrophilic silica is mixed with silicone oil and heated with high shear rate stirring, for example, as described by S Ross and G Nishioka and J Colloid and Interface Science, Vol 65(2), June 1978, page 216.

(b)(iii) Other antifoam promoters

Phosphorus-free antifoam promoters that may be used as alternatives or supplements to the alkyl phosphoric acid salts (b)(i) and hydrophobic silica (b)(ii) mentioned above are nitrogen-containing compounds having the formulae:

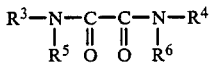
(2)

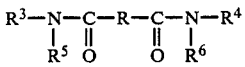
(3)

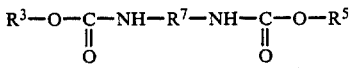
(4)

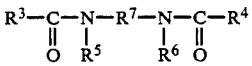
(5)

where $R^3$ and $R^4$ are the same or different $C_5$ to $C_{25}$ aliphatic groups, $R^5$ to $R^6$ are hydrogen, or the same or different $C_1$ to $C_{22}$ aliphatic groups; and $R^7$ is a $C_1$ to $C_9$ aliphatic group.

The preferred nitrogen compounds are those having the structure (5), for example, those where $R^3$ and $R^4$ are the same or different $C_{14}$ to $C_{22}$ aliphatic groups.

The most preferred nitrogen compounds are alpha, omega-dialkylamide alkanes, especially alpha, omega-distearylamide methane or ethane (also known as methylene and ethylene distearamides) having the structure:

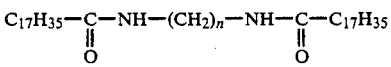
(6)

where n is the integer 1 to 2.

The nitrogen compound antifoam actives are particularly suitable for use in detergent compositions which, for environmental reasons, contain little or no phosphorus-containing compounds.

If desired, the antifoam material contained in the antifoam ingredient of the invention may additionally or alternatively comprise antifoam active substances and/or antifoam promoters other than those specified above.

Especially preferred combinations of antifoam active substances (oily or waxy) and antifoam promoters (particulate materials or precursors thereof) are the following:

(a) the active, hydrocarbon together with the promoter, hydrophobic silica;

(b) the active, silicone together with the promoter, hydrophobic silica, commercially available examples of which are DB 100 available from Dow Corning, VP 1132 available from Wacker and Silcolapse 430 available from ICI, as mentioned previously;

(c) the active, hydrocarbon together with the promoter alkyl phosphoric acid salt, an example of which is petroleum jelly and stearyl phosphate (e.g. Alf (Trade Mark) 5 available from Lankro Chemicals); preferred weight ratio of hydrocarbon to stearyl phosphate is 90:10, most preferably 60:40;

(d) the actives, hydrocarbon and a silicone, together with the promoters, alkyl phosphate and hydrophobic silica.

It may be necessary to exercise care when preparing mixtures of antifoam active and promoter, in order to obtain a blend which is suitable subsequently to be supported in an oil-impervious matrix of acid soap.

By way of example, mixtures of alkyl phosphates or nitrogen-containing compounds with hydrocarbons, as herein defined, are preferably prepared as melts for subsequent dispersion in matrix material comprising the acid soap. Mixtures of insoluble particulate promoters such as calcium alkyl phosphates or hydrophobic silica with hydrocarbon are preferably prepared by adding the particulate ingredient(s) to the liquefied hydrocarbon, and subjecting the mixture to high shear mixing.

Mixtures of polydimethylsiloxane and hydrophobic silica are preferably subjected to high shear mixing before mixing with the matrix material. As previously indicated, these materials can also be prepared by mixing hydrophilic silica with polydimethylsiloxane and heating at high shear rate, in order to convert the silica to hydrophobic silica in situ, for example as described by S. Ross and G. Nishioka in J. Colloid and Interface Science, Vol 65(2), June 1978, page 216.

Preferred proportions of components

The total amount of antifoam material (antifoam active substance plus optional promoter) carried by the matrix is generally from 5 to 50%, preferably from 20 to 45% and most preferably from 35 to 40% by weight of the total antifoam ingredient. The matrix generally forms from 50 to 95%, preferably from 55 to 70% and most preferably from 55 to 65% by weight of the total antifoam ingredient.

If both antifoam active substance and antifoam promoter are present, the antifoam active substance or substances can form from 1 to 99% by weight, and the antifoam promoter from 1 to 99% by weight, of the total antifoam material enclosed in the acid soap matrix. Preferably the antifoam active substance constitutes form 75 to 95% by weight, and the antifoam promoter from 5 to 25% by weight, of the total antifoam material present.

Minor amounts of other ingredients, for example, flow aids such as calcium stearate, may also be present.

PROCESS FOR MANUFACTURE OF ANTIFOAM INGREDIENT

A further aspect of the invention provides a process for the manufacture of the antifoam ingredient according to the invention, which is then suitable for incorporation for example into detergent powder products, particularly those intended for the washing of fabrics in the domestic automatic washing machine.

The process of the invention comprises the following steps:

(i) preparing a molten mixture of the fatty acid and the fatty acid soap;

(ii) incorporating the antifoam material into the molten fatty acid/soap mixture;

(iii) cooling the resulting mixture to form solid particulate material.

There are several possible methods for carrying out the cooling and solidification step (iii). One preferred process involves spray-cooling the mixture of antifoam material and molten acid soap in a spray-drying tower to form prills. A second method involves solidifying the mixture of antifoam material and molten acid soap onto the surface of a cooled drum or belt, scraping the solidified antifoam ingredient from the drum or belt, and milling the flaky material thus obtained to form a particulate solid of the desired size. Yet another method involves cooling the mixture of antifoam material and molten acid soap and extruding it through a die to form noodles. These may then be converted to the desired size by low energy milling and sieving operations.

Whatever method of manufacture is used, it has been found that greater storage stability is achieved if the average particle size of the antifoam ingredient is at least 500 μm.

DETERGENT COMPOSITIONS

The antifoam ingredient according to the invention is particularly suitable for incorporation in a detergent powder composition, in which case, such a composition can comprise from 0.1 to 5%, preferably from 0.2 to 3% and most preferably from 0.5 to 2% by weight of the antifoam ingredient. Detergent compositions of the invention also contain one or more detergent-active compounds and one or more detergency builders, and may contain other conventional ingredients, for example, bleaching materials, enzymes, antiredposition agents and fluorescers.

Detergent compositions of the invention will generally comprise one or more detergent active compounds which can be chosen from soap and non-soap anionic, cationic, nonionic, amphoteric or zwitterionic detergent active compounds, and mixtures thereof. Many suitable detergent-active compounds are commercially available and are fully described in the literature, for example in "Surface Active Agents and Detergents", Volumes I and II, by Schwartz, Perry and Berch.

The preferred detergent-active compounds which can be used are soaps and synthetic non-soap anionic and nonionic compounds.

Synthetic anionic non-soap detergent active compounds are usually water-soluble alkali metal salts of organic sulphuric and sulphonic acids having alkyl radicals containing from about 8 to about 22 carbon atoms, the term alkyl being used to include the alkyl portion of higher aryl radicals.

The preferred anionic detergent compounds are sodium ($C_{11}$–$C_{15}$) alkyl benzene sulphonates and sodium ($C_{16}$–$C_{18}$) alkyl sulphates.

Examples of suitable nonionic detergent compounds which may be used include the condensation products of aliphatic ($C_8$–$C_{25}$) primary or secondary linear or branched alcohols with ethylene oxide, generally 2 to 30 EO. Other so-called nonionic detergent compounds include long-chain tertiary amine oxides, long-chain tertiary phosphine oxides and dialkyl sulphoxides.

Mixtures of detergent-active compounds, for example mixed anionic or mixed anionic and nonionic compounds, are preferably used in the detergent compositions.

The detergent active component of the detergent powder composition will generally comprise from 5 to 40%, preferably from 8 to 30% by weight of the composition, and can be incorporated into the composition by any suitable method, for example, spray-drying, spray-on or as a separately prepared adjunct.

Detergency builders that may be present in the detergent compositions of the invention include soaps, inorganic and organic water-soluble builder salts, as well as various water-insoluble and so-called "seeded" builders, whose function is to soften hard water by solubilisation or by removal by other means (e.g. by sequestration, precipitation or ion exchange) of calcium and to a lesser extent magnesium salts responsible for water hardness, thereby improving detergency.

Detergency builders are exceedingly well known in the art and include phosphates, carbonates, citrates, nitrilotriacetates, various polymeric polycarboxylates such as polyacrylates, and aluminosilicates.

Detergency builders will generally comprise from about 1 to 90% by weight, preferably from about 5 to 75% by weight, of the detergent composition.

Detergent compositions incorporating the antifoam ingredient of the invention may also include any other components conventionally used, for example: bleaching ingredients such as persalts, for example, sodium perforate, with activators such as tetraacetyl ethylenediamine, or peroxyacids; sodium silicate; antiredeposition agents such as sodium carboxymethyl cellulose; inorganic salts such as sodium sulphate; enzymes such as proteases and amylases; optical brighteners; and perfumes.

Detergent compositions in accordance with the invention can be employed in a normal domestic or other laundry or dishwashing process conveniently employing a washing machine. For most purposes, the detergent composition can be employed at a concentration of 0.05 to 5% by weight of the wash liquor. Preferably, the concentration in the wash is from 0.2 to 2%, most preferably from 0.3 to 1.5% by weight of the wash liquor.

EXAMPLES

The invention is illustrated by the following non-limiting Examples.

EXAMPLES 1 TO 4

A fabric washing powder was manufactured by standard slurry-making, spray-drying and dry-dosing techniques to the following formulations:

| | % by weight |
|---|---|
| Sodium alkylbenzene sulphonate | 9.0 |
| $C_{13-15}$ ethoxylated alcohol 7EO | 4.0 |
| Sodium soap | 0.5 |
| Sodium tripolyphosphate | 15.0 |
| Sodium aluminosilicate | 10.0 |
| Sodium silicate | 4.0 |
| Sodium sulphate | 16.5 |
| Sodium perborate tetrahydrate | 11.0 |
| *Antifoam ingredient | 0.5 |

-continued

| | % by weight |
|---|---|
| Minor components, water | to 100.0 |

*The antifoam ingredient referred to had one of the following formulations:

| | | % by weight | | | |
|---|---|---|---|---|---|
| | | I | II | III | IV |
| Hydrophobed silica/ paraffin oil mixture | (6:94) | — | 40.0 | 36.9 | 40.0 |
| | (12:88) | 38.0 | — | — | — |
| Lauric acid | | 34.0 | 29.7 | 27.4 | 23.7 |
| Sodium stearate/palmitate | | 19.2 | 30.3 | 28.0 | 36.3 |
| Calcium stearate(free flow agent) | | 8.8 | — | 7.7 | — |
| % by weight liquid phase at 40° C. as measured by pulse NMR | | 33 | 5 | 5 | 1 |
| Ratio of acid to soap | | 1.77 | 0.98 | 0.97 | 0.65 |
| Krafft point (of fully neutralised soap), °C. | | 40 | 43 | 43 | 47 |

These antifoam ingredients were manufactured as follows:

Hydrophobed silica (Sipernat (Trade Mark) D-10 manufactured by Degussa), having a specific surface area of 90 $m^2/g$ and a mean crystal size of 18 nm was suspended in paraffin oil having a melting point of about −6° C. and a viscosity of 19 mPas measured at 25° C. This material was then incorporated into a melt containing the lauric acid and the sodium stearate/palmitate in the desired proportions. The acid soap mixture was allowed to solidify and then extruded through a die to form noodles. Calcium stearate was then added as a flow promoter.

The foam profile of the fabric washing powder containing antifoam ingredients I to IV was then assessed using the following experimental protocol. A sample of the powder containing the desired antifoam ingredient was divided into two parts. One part was subjected immediately to the test protocol while the other part was stored for four weeks at 37° C. and 70% Relative Humidity in normal sealed cartons. 4 kg of clean cotton cloths were washed in a Miele W-765 (Trade Mark) washing machine using the main wash sequence only. The weight of powder used was 135 g per wash cycle, and the total water intake was 17 liters of hardness 8°–9° DH. The foam profiles obtained are shown in Tables 1–3.

TABLE 1

Foam profiles of powders containing antifoam I (40° cycle)

| Time (mins) | Temperature (°C.) | Foam Height* Fresh Powder | Stored Powder | Comments |
|---|---|---|---|---|
| 0 | 20 | 0 | 0 | |
| 5 | 30 | 0.6 | 0.6 | |
| 10 | 40 | 0 | 0 | |
| 15 | 40 | 0 | 0 | |
| 20 | 40 | 0.3 | 0.3 | |
| 25 | 40 | 0.8 | 0.8 | |
| 30 | 40 | 1.1 | 1.1 | Flood |
| 32 | 32 | 7.0 | 6.0 | |
| 35 | 25 | 7.0 | 6.0 | 1st rinse |
| 40 | 22 | 7.0 | 6.0 | 2nd rinse |

*Arbitrary Units, scale 0–10

TABLE 2

Foam profiles of powders containing Antifoam I (90° cycle)

| Time (mins) | Temperature °C. | Foam Height* Fresh Powder | Stored Powder | Comments |
|---|---|---|---|---|
| 0-60 | 20–90 | 0 | 0 | |
| 70 | 39 | 7.5 | 6.7 | Flood |

*Arbitrary Units, scale 0–10

TABLE 3

Foam profiles of powders containing Antifoams II–IV (40° cycle)

| Time (mins) | Temperatures °C. | Foam Height* Fresh Powder | Stored Powder | Comments |
|---|---|---|---|---|
| 0 | 17 | 0 | 0 | |
| 5 | 30 | 0 | 0 | |
| 10 | 40 | 0 | 0 | |
| 15 | 40 | 0 | 0 | |
| 20 | 40 | 0 | 0 | |
| 25 | 40 | 0.5 | 0 | |
| 30 | 40 | 1.0 | 0 | |
| 32 | 32 | 6.0 | 5.0 | Flood |
| 35 rinse | 25 | 8.0 | 5.0 | lst |
| 40 rinse | 22 | 7.0 | 3.0 | 2nd |

*Arbitrary Units, scale 0–10

EXAMPLES 5 & 6

Fabric washing powders were manufactured by standard slurry-making, spray-drying and dry-dosing techniques to the following formulations:

| | % by weight | |
|---|---|---|
| Sodium alkylbenzene sulphonate | 9.0 | 9.0 |
| $C_{13}-C_{15}$ ethoxylated alcohol 7EO | 1.0 | 1.0 |
| $C_{13}-C_{15}$ ethoxylated alcohol 3EO | 3.0 | 3.0 |
| Sodium tripolyphosphate | 17.8 | 21.5 |
| Sodium silicate | 5.5 | 5.5 |
| Sodium sulphate | 26.4 | 26.7 |
| TAED granules (65% TAED) | 4.6 | 4.6 |
| Sodium perborate monohydrate | 5.0 | 5.0 |
| Antifoam ingredient (as active material)* | — | |
| Example V | 1.7 | — |
| Example VI | — | 0.5 |
| Minor components, water | to 100.0 | |

*The antifoam ingredients V and VI had the following formulations:

| | V | VI |
|---|---|---|
| Hydrophobed silica/paraffin oil mixture (12:88) | 35.0 | — |
| DB-100 (ex Dow Corning) | — | 35.0 |
| Lauric acid. | 32.5 | 26.0 |
| Sodium stearate/palmitate | 32.5 | 39.0 |
| % liquid phase content | 5 | 1 |
| Ratio of acid to soap | 1.0 | 0.67 |
| Krafft point (of fully neutralised soap), °C. | 43 | 47 |

These antifoam ingredients were manufactured as follows. The active materials were:

A hydrophobic silica (Sipernat (Trade Mark) D10 manufactured by Degussa), having a specific surface area of 90 $m^2g^{-1}$ and a mean crystal size of 18 mm, was suspended in a paraffin oil having a melting point of about −6° C. and a viscosity of 19 mPas measured at 25° C., and A commercially available hydrophobic silica/-polysiloxane mixture (DB100 (Trade Mark) manufactured by Dow Corning).

This active material was incorporated into a melt containing the lauric acid and the sodium stearate/palmitate in the desired proportions, The hot mixture was then sprayed into a tower. The resulting droplets solidified as they fell forming prills.

The foam profiles of the fabric washing powders containing antifoam ingredients V and VI were then assessed using the following experimental protocol. A sample of each powder was divided into two parts. One part was subjected immediately to the test protocol while the other part was stored for four weeks at 37° C. and 70% relatively humidity in normal sealed cartons. 4 kg of clean cotton cloths were washed in a Miele W-765 (Trade Mark) or in a Thomson Brandt Z8500 (Trade Mark) washing machine using the main wash sequence only. The weights of powder used were 135 g and 165 g respectively per wash cycle, and the total water intakes were 17 and 20 liters respectively of hardness 8°-9° DH. The foam profiles obtained are shown in Tables 4 to 6.

TABLE 4

Foam profile of powder containing antifoam V in Miele W 765 (40° C. cycle)

| Time (mins) | Temperature (°C.) | Foam Height* Fresh powder | Stored powder | Comments |
|---|---|---|---|---|
| 0 | 20 | 0 | 0 | |
| 5 | 30 | 0 | 0.5 | |
| 10 | 40 | 0 | 0.5 | |
| 15 | 40 | 0 | 0.5 | |
| 20 | 40 | 0 | 1.5 | |
| 25 | 40 | 0.5 | 4.0 | |
| 30 | 40 | 1.0 | 5.5 | |
| 32 | 32 | 6.0 | 8.5 | Flood |
| 35 | 25 | 2.0 | 5.5 | 1st rinse |
| 40 | 22 | 2.0 | 5.0 | 2nd rinse |

*Arbitrary Units, scale 0–10

TABLE 5

Foam profile of powder containing antifoam VI in a Miele W 765 (40° C. cycle)

| Time (mins) | Temperature (°C.) | Foam Height* Fresh powder | Stored powder | Comments |
|---|---|---|---|---|
| 0 | 20 | 0 | 0 | |
| 5 | 30 | 0 | 0.5 | |
| 10 | 40 | 0 | 0 | |
| 15 | 40 | 0 | 0 | |
| 20 | 40 | 0 | 0 | |
| 25 | 40 | 0.5 | 0 | |
| 30 | 40 | 0.5 | 0.5 | |
| 32 | 32 | 6.0 | 6.0 | Flood |
| 35 | 25 | 5.5 | 4.5 | 1st rinse |
| 40 | 22 | 4.0 | 3.5 | 2nd rinse |

*Arbitrary Units, scale 0–10

TABLE 6

Foam profile of powder containing antifoam V in a Thomson Brandt Z8500 (40° C. cycle)

| Time (mins) | Temperature (°C.) | Foam Height* Fresh powder | Stored powder | Comments |
|---|---|---|---|---|
| 0 | 20 | 0 | 0 | |
| 5 | 30 | 4.0 | 8.5 | |
| 10 | 35 | 4.0 | 6.0 | |
| 15 | 35 | 4.0 | 6.0 | |
| 20 | 35 | 5.0 | 6.0 | |
| 25 | 35 | 5.0 | 7.0 | |
| 30 | 35 | 5.0 | 7.5 | |
| 35 | 35 | 5.5 | 7.5 | |
| 40 | 35 | 6.0 | 7.5 | |

TABLE 6-continued

Foam profile of powder containing antifoam V in a Thomson Brandt Z8500 (40° C. cycle)

| Time (mins) | Temperature (°C.) | Foam Height* Fresh powder | Stored powder | Comments |
|---|---|---|---|---|
| 42 | 28 | 4.5 | 7.5 | Flood |
| 45 | 22 | 1.5 | 5.5 | 1st rinse |
| 50 | 20 | 0.5 | 0.5 | 2nd rinse |

*Arbitrary Units, scale 0–15

TABLE 7

Foam profile of powder containing antifoam VI in a Thomson Brandt Z8500 (40° C. cycle)

| Time (mins) | Temperature (°C.) | Foam Height* Fresh powder | Stored powder | Comments |
|---|---|---|---|---|
| 0 | 20 | 0 | 0 | |
| 5 | 30 | 0 | 6.5 | |
| 10 | 35 | 0 | 2.5 | |
| 15 | 35 | 0 | 2.5 | |
| 20 | 35 | 1.0 | 2.5 | |
| 25 | 35 | 2.0 | 3.0 | |
| 30 | 35 | 2.0 | 3.0 | |
| 35 | 35 | 2.0 | 2.0 | |
| 40 | 35 | 2.0 | 2.0 | |
| 42 | 28 | 3.0 | 3.0 | Flood |
| 45 | 22 | 3.0 | 2.0 | 1st rinse |
| 50 | 20 | 0 | 0 | 2nd rinse |

It can be seen that the antifoam ingredients in accordance with the invention inhibit foam development throughout the wash process in both the high and low temperature cycles.

We claim:

1. A particulate solid antifoam ingredient suitable for incorporation into a detergent powder, the antifoam ingredient being in the form of a matrix comprising a mixture of a $C_{8-22}$ fatty acid and an alkali metal soap of a $C_{8-22}$ fatty acid wherein the weight ratio of fatty acid to soap in the mixture is within the range of from 0.25:1 to 2:1, said mixture having a liquid phase content at 40° C. of not more than 50% by weight, enclosing an antifoam material consisting essentially of an antifoam active substance selected from the group consisting of hydrocarbons, polysiloxanes, mixtures thereof and mixtures of any of the foregoing with an antifoam promoter, which antifoam promoter is selected from the group consisting of alkyl phosphoric acids and salts thereof, hydrophobic silica, and mixtures thereof.

2. An antifoam ingredient as claimed in claim 1, wherein the fatty acid/soap mixture has a liquid phase content at 40° C. of not more than 40% by weight.

3. An antifoam ingredient as claimed in claim 2, wherein the fatty acid/soap mixture has a liquid phase content at 40° C. of not more than 10% by weight.

4. An antifoam ingredient as claimed in claim 1, wherein the Krafft point of the fully neutralised soap corresponding to the fatty acid/soap mixture is within the range of from 10° to 60° C.

5. An antifoam ingredient as claimed in claim 4, wherein the Kraft point of the fully neutralised soap corresponding to the fatty acid/soap mixture is within the range of from 20° to 60° C.

6. An antifoam ingredient as claimed in claim 1, wherein the fatty acid/soap mixture comprises a fatty acid selected from lauric acid, myristic acid, palmitic acid, stearic acid, oleic acid and mixtures thereof.

7. An antifoam ingredient as claimed in claim 1, wherein the fatty acid/soap mixture comprises a soap selected from the sodium and potassium soaps and lauric acid, myristic acid, palmitic acid, stearic acid, oleic acid and mixtures thereof.

8. An antifoam ingredient as claimed in claim 1, wherein the weight ratio of fatty acid to soap in the mixture is within the range of from 0.67:1 to 1.5:1.

9. An antifoam ingredient as claimed in claim 1, which comprises from 5 to 50% by weight of the antifoam material and from 50 to 95% by weight of the fatty acid/soap mixture.

10. An antifoam ingredient as claimed in claim 9, which comprises from 20 to 45% by weight of the antifoam material and from 55 to 70% by weight of the fatty acid/soap mixture.

11. A process for the preparation of an antifoam ingredient in the form of a matrix comprising a mixture of a $C_{8-22}$ fatty acid and an alkali metal soap of a $C_{8-22}$ fatty acid wherein the weight ratio of fatty acid to soap in the mixture is within the range of from 0.25:1 to 2:1, said mixture having a liquid phase content at 40° C. of not more than 50% by weight, enclosing an antifoam material consisting essentially of an antifoam active substance selected from the group consisting of hydrocarbons, polysiloxanes, mixtures thereof and mixtures of any of the foregoing with an antifoam promoter, which antifoam promoter is selected from the group consisting of alkyl phosphoric acids and salts thereof, hydrophobic silica, and mixtures thereof, which process comprises the steps of:

(i) preparing a molten mixture of the fatty acid and the fatty acid soap;

(ii) incorporating the antifoam material into the molten fatty acid/soap mixture;

(iii) cooling the resultant mixture to form solid particulate material.

12. A process as claimed in claim 11, wherein step (iii) comprises spray-cooling the mixture of antifoam material and molten fatty acid/soap to form prills.

13. A process as claimed in claim 11, wherein step (iii) comprises solidifying the mixture of antifoam material and molten fatty acid/soap onto the surface of a cooled drum or belt, scraping the solidified antifoam ingredient from the drum or belt, and milling the solidified antifoam ingredient to form a particulate solid.

14. A process as claimed in claim 11, wherein step (iii) comprises cooling the mixture of antifoam material and molten fatty acid/soap and extruding it through a die to form noodles.

15. A detergent composition comprising one or more anionic and/or nonionic detergent-active materials, one or more detergency builders, and optionally other conventional ingredients, which comprises from 0.1 to 5.0% by weight of an antifoam ingredient as claimed in claim 1.

16. A particulate solid antifoam ingredient suitable for incorporation into a detergent powder, the antifoam ingredient being in the form of a matrix comprising a mixture of a $C_{8-22}$ fatty acid and an alkali metal soap of a $C_{8-22}$ fatty acid wherein the weight ratio of fatty acid to soap in the mixture is within the range of from 0.25:1 to 2:1, said mixture having a liquid phase content at 40° C. of not more than 50% by weight, enclosing an antifoam material consisting essentially of (i) an antifoam active substance selected from the group consisting of hydrocarbons, polysiloxanes and mixtures thereof; and (ii) antifoam promoter selected from the group consisting of alkyl phosphoric acids and salts thereof, hyrophobic silica, and mixtures thereof.

* * * * *